United States Patent [19]

Deutch

[11] 4,175,340

[45] Nov. 27, 1979

[54] FORM BOOK

[76] Inventor: Howard E. Deutch, 6826 Casselberry Way, San Diego, Calif. 92119

[21] Appl. No.: 838,060

[22] Filed: Sep. 30, 1977

[51] Int. Cl.[2] ..... B42D 1/08

[52] U.S. Cl. ..... 35/53; 35/28; 281/16

[58] Field of Search ..... 35/7 R, 7 A, 24 A, 27, 35/28, 35 E, 53, 54, 61, 62, 66, 71; 40/159; 96/43; 281/22, 50, 16; 355/75

[56] References Cited

U.S. PATENT DOCUMENTS

| | | | |
|---|---|---|---|
| 2,155,924 | 4/1939 | Barrett | 35/53 |
| 2,308,628 | 1/1943 | Rider | 281/16 X |
| 2,586,017 | 2/1952 | Freedman | 273/282 |
| 3,028,178 | 4/1962 | Pietrangeli | 35/35 E X |
| 3,208,772 | 9/1965 | Dahlstrand | 35/62 X |
| 3,563,782 | 2/1971 | Liberman | 35/66 X |
| 3,696,532 | 10/1972 | Nahon | 35/62 |

FOREIGN PATENT DOCUMENTS

| | | | |
|---|---|---|---|
| 614253 | 12/1948 | United Kingdom | 281/16 |

OTHER PUBLICATIONS

"Magic Magnetic Photo Album", Feb. 1975.

*Primary Examiner*—Harland S. Skogquist
*Attorney, Agent, or Firm*—Fleit & Jacobson

[57] ABSTRACT

A form book for compiling a document from a plurality of individual elements containing information. The form book includes a ring binder, a plurality of element holding members attached to the rings of the binder, a plurality of elements containing information arranged in stacks within the holding members with one edge held by the rings of the binder and at least the top element in each stack held by the holding member. The preceding holding member is adapted to hold at least one edge of elements removed from the following holding member. A method using the described form book and an element adapted for use with the form book.

14 Claims, 7 Drawing Figures

FORM BOOK

BACKGROUND OF THE INVENTION

Field of the Invention

This invention relates to a method and device for forming a compiled document from a plurality of elements containing information. More specifically, the present invention is particularly adapted for compiling documents from a plurality of stacked elements containing alternate expressions of similar information.

DESCRIPTION OF THE PRIOR ART

Copy and practice books and quiz devices are known in which a first transparent sheet overlays a printed opaque sheet. A user reads the printed material and makes appropriate responses on the transparent sheet. A second transparent sheet containing the correct responses is then interposed between the first transparent sheet and the opaque sheet to allow the user to check the accuracy of responses. No provision is made for rearranging the component parts of the material printed on the opaque sheets to form different composite pages.

Also known are systems for forming a composite pictorial representation from several component parts. In the system described in U.S. Pat. No. 3,353,281, a composite is formed by superimposing a plurality of transparent sheets, each sheet containing a representation of a different facial characteristic. In U.S. Pat. No. 3,896,565, a composite system is described in which facial characteristics are placed on individual magnetized elements. Selected ones of the elements are placed on a backing plate in a partially overlapping relationship and held in place by magnetic attraction. No provision is made for keeping the individual elements not used in any prescribed sequence and only the elements selected are associated with the backing plate.

Also known are compilations of forms, such as, *Bender's Federal Practice Forms* (Matthew Bender, New York, N.Y.). Such compilations provide a collection of sample forms or documents for use in different situations. The forms are usually grouped by subject matter with a general form and variations thereof in the same section of the compilation. A practitioner first checks to see if there is a particular form that satisfies his needs. If no single form can be found, then the practitioner must assemble a form by selecting relevant parts from several different forms. Such a compilation can be inconvenient and time consuming. The end product can be difficult to visualize unless copies of the component parts are made during the selecting process. Also, there is no convenient way to convey to a secretary the information needed to type the compiled form for a particular client.

SUMMARY OF THE INVENTION

Accordingly, it is an object of the present invention to overcome the disadvantages of the previously known devices and methods for forming compiled documents.

In accordance with the present invention, an improved method of forming a compiled document from a plurality of elements containing information is provided. When compiling a document using the disclosed method, a user places first and second element holding means in the rings of a binder. Individual elements containing information, such as, alternative expressions of a legal statement, are combined into stacks and placed in the second element holding means with one edge of each of the elements being held by the rings of the binder. At least the top element of each stack has an edge held by the second element holding means thereby holding at least the top elements in predetermined positions. After the elements have been properly placed in the binder, a compiled document can be formed by selectively removing elements from the top of each stack until the desired elements are positioned at the top. The elements removed from each stack are held in order by the first element holding means. In one embodiment of applicant's invention, the second element holding means includes a transparent sheet that overlays the top elements in each stack thus allowing review of the compiled document. Also, the transparent sheet can be written on with water soluble ink to fill in blank spaces in the individual elements.

When it is desired to form several compiled documents, a plurality of first and second element holding means are placed in the rings of the binder. In such a case, first and second element holding means can be combined into a single holding member. Elements removed from the second element holding means of a holding member are releasably held by the first element holding means of the preceding holding member.

The invention also provides both a device and an individual element containing information for use with the above described method.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
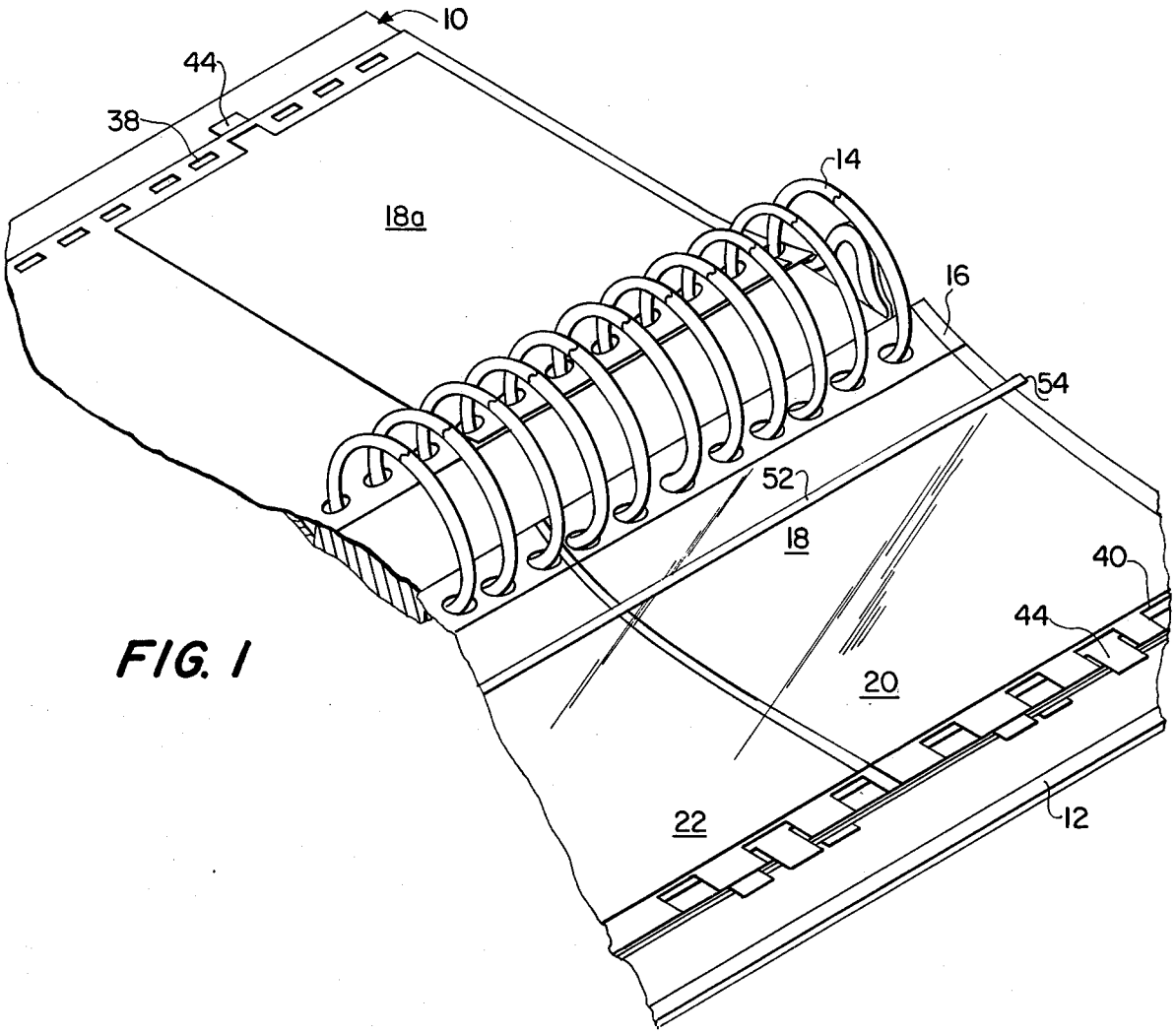
FIG. 1 is a perspective view with parts broken away of one embodiment of the form book of the present invention.

Because form books are well known, the present description will be directed in particular to elements forming part of, or cooperating more directly with, the present invention, and elements not specifically shown or described herein are understood to be selectable from those known in the art.

Referring now to the drawings, and to FIGS 1-3 in particular, one embodiment of the present invention is illustrated and will be described in connection with a form book, generally designated 10.

The form book 10 includes a binder 12 having a plurality of rings 14 that can be opened and closed to releasably hold holding members 16 and elements or inserts 18. The inserts 18 are arranged in a plurality of adjacent stacks, two of which designated 20 and 22 respectively, are illustrated.

Figure 2:
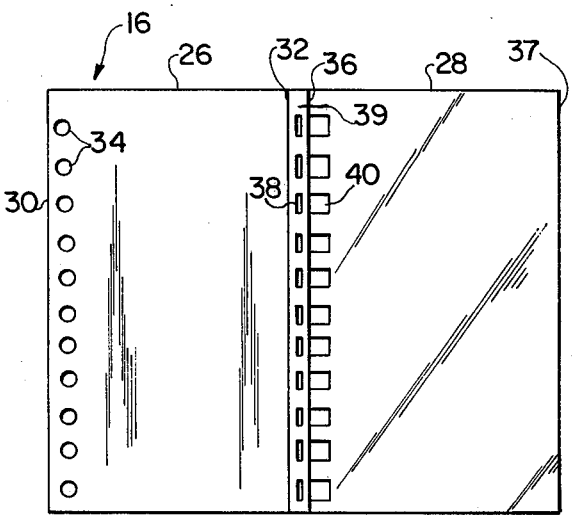
FIG. 2 is a plan view of a holding member used with the form book illustrated in FIG. 1.

Turning now to FIG. 2, the holding member 16 illustrated in FIG. 1 will be described in detail. Holding member 16 has a backing sheet 26 and a front sheet 28. Preferably, the backing sheet is opaque to prevent inadvertent viewing of inserts 18 held in a succeeding holding member 16. Also, the side of the backing sheet facing the succeeding holding member can be coated to prevent transfer of any writing from the front sheet of the succeeding holding member. The front sheet is preferably transparent or semitransparent to allow viewing of inserts 18 positioned within the holding member. One edge 30 of the backing sheet 26 contains a plurality of slits, apertures or circular openings 34 for attaching holding member 16 to the rings 14 of binder 12. The other edge 32 of backing sheet 26 meets an edge 36 of front sheet 28. A strip of tape 39 connects the edges 32 and 36 to each other thus forming an envelope or sleeve for holding inserts 18. A plurality of slits, holes or openings 38 are formed in backing sheet 26 near edge 32. Similar apertures or openings 40 are formed in the front of front sheet 28 in alignment with the openings 38. The purpose of these slits or openings will be described in conjunction with the description of the insert 18. If a large number of inserts 18 are to be held in the holding member 16, one of the edges 32 and 36 is formed with an accordian or U-shape to allow separation of the sheets 26 and 28 from each other. In such a case, the edges 32 and 36 are overlapped before being taped, glued, or otherwise affixed to each other. Also, in one embodiment, sheets 26 and 28 are formed from an integral sheet of material eliminating the need to attach edges 32 and 36 to each other.

Figure 3:
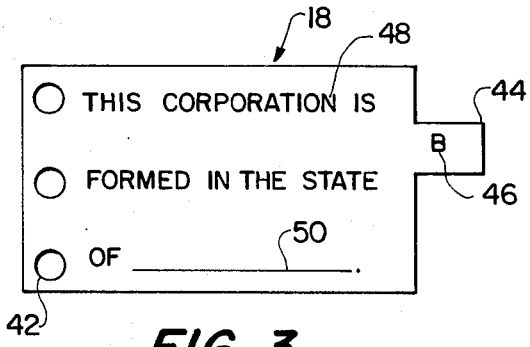
FIG. 3 is a plan view of an insert used with the form book of FIG. 1.

Turning now to FIG. 3, an insert 18 used with the binder 12 is illustrated in detail. The insert 18 contains one or more slits or circular openings 42 for attaching the insert to one or more rings 14 of binder 12. A protruding or tabular portion 44 is formed in the edge of insert 18 opposite the openings 42. The tabular portion 44 contains indicia, generally designated 46, representative of the information contained on the insert 18. Such indicia is printed, handwritten, or color coded. If the inserts are periodically updated, the indicia indicates the date of the material contained on the insert. Also, all or part of the tabular portion 44 is color coded to facilitate formation of particular predetermined documents. Each of the inserts 18 in a given stack 20 or 22 contains variations of a particular type of information. One example of such information is indicated by the reference numeral 48 in FIG. 3. It is to be noted that one or more blank spaces 50 are provided on the insert 18. In certain cases, the entire insert 18 could be blank.

The use of the embodiment of applicant's invention illustrated in FIGS. 1–3 will now be explained. Before the form book 10 can be used, one or more holding members 16 and a plurality of inserts 18 must be positioned therein. The positioning is accomplished by opening the rings 14, placing the openings 34 of one or more holding members 16 on the rings, placing a plurality of inserts 18 arranged in stacks within each of the holding members 16 and closing the rings 14. The inserts 18 are maintained in alignment by the combination of the engagement of the rings 14 with the openings 42 and the protrusion of the tabular portions 44 through the slits or openings 40 in the front sheet 28. After all of the holding members and inserts have been positioned in the form book, the form book is ready for use.

A user of the form book first turns to a desired holding member and folds back the edge 37 of the front sheet 40 thus exposing all of the inserts 18. The user then examines the inserts in each of the stacks 20 and 22 and selects the desired insert. Inserts in each stack above the desired insert are removed from the holding member without being removed from binder 12 and transfered in order to the preceding holding member. These inserts, designated **18*a* in FIG. 1, are held to the preceding holding member 16 by the engagement of tabular portions 44 with the slits 38 and 40. Since the slits 40 are expected to hold inserts from two different holding members, the slits 40, as illustrated in FIG. 2, are larger than the slits 38. After all of the desired inserts 18 have been positioned at the top of the stacks 20 and 22, the front sheet 28 is folded back over the inserts with the openings 40 holding the inserts 18 in predetermined positions. The user of the form book is then able to fill in any blank spaces 50 in the inserts 18 by writing on the front of front sheet 28**. When a water soluble ink is used to write the desired information, subsequent cleaning and reuse of the front sheet is greatly simplified.

Compilation of a particular predetermined document can be facilitated by color coding or numerically coding the particular inserts needed for a particular document. With such a system, a user of the form book need only position at the top of each stack 20, 22 all inserts having similar color coded or numerically coded tabs. For instance, if the holding members hold inserts pertaining to the acquisition of one corporation by another, all inserts pertaining to a cash purchase would be color coded red with inserts pertaining to a stock purchase color coded blue. By checking an index and selecting the appropriate color code, the need to check the information on each insert would be reduced.

After a particular document has been compiled, the openings 40 hold the tabular portions 44 and the inserts 18 in desired position. Alternatively or in addition, clamp or holding element 52 having a protruding portion 54 is attached to the holding member to indicate that the holding member contains a document to be typed. The clamp 52 is formed of plastic or similar deformable material and is releasably positioned around the holding member 16. The clamp 52 is positioned either close to the rings 14, as illustrated in FIG. 1, or anywhere along the holding member 16. Instead of using a member such as holding member 52 to indicate the particular holding members containing documents to be typed, a user can attach a paper clip or other identifying indicia to a particular holding member.

In an alternative embodiment of applicant's invention, the need for the tabular portions 44 and the openings 38 and 40 is eliminated by coating front sheet 28 and possibly backing sheet 26 with a material that electrostatically attracts the inserts 18, thus, holding them in desired positions.

Figure 4:
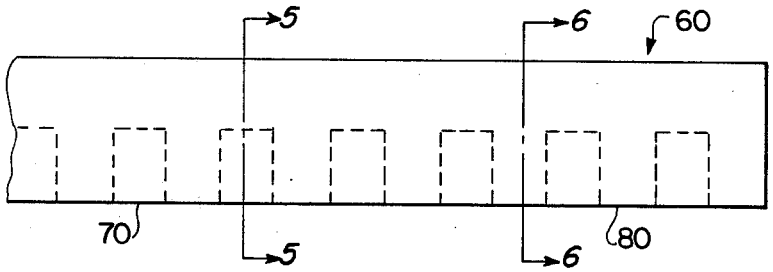
FIG. 4 is a top plan view of an alternative embodiment of a holding member used with the form book of FIG. 1.
Figure 5:
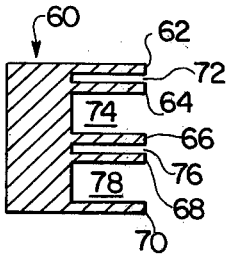
FIG. 5 is a cross-sectional view taken along line 5—5 of FIG. 4.
Figure 6:
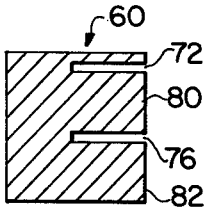
FIG. 6 is a cross-sectional view taken along line 6—6 of FIG. 4.

Turning now to the embodiment of applicant's invention illustrated in FIGS. 4–6, an alternative embodiment of holding member 16 is illustrated. The illustrated embodiment has a holding device 60 which has a plurality of longitudinally extending protruding portions 62, 64, 66, 68, and 70 which define openings 72, 74, 76, and 78, respectively. Opening 72 is adapted to hold an edge of a front sheet similar to front sheet 28. Openings 74 and 78, which are broken into a plurality of individual openings, notches or protuberance receiving portions by vertical wall portions 80 and 82 respectively, are adapted to receive tabular portions 44 of inserts 18. Opening 76 is adapted to hold one edge of a backing sheet similar to backing sheet 26, the other edge of the backing sheet being held by the rings 14 of the binder 12.

It is to be recognized that the cross-sections illustrated in FIGS. 5 and 6 have been enlarged to facilitate the description of the invention. The depth of openings 72 and 76 need be no larger than the thickness of the backing and front sheets to be held. The sides of the protruding portions of the holding device forming the openings 72 and 76 can be serrated to facilitate the gripping and retention of sheets inserted therein. The depth of the openings 74 and 78 is determined by the maximum number of inserts held by the holding device 60. Also, the openings 74 and 78 need not have a rectangular shape as illustrated. Any shape can be used as long as the tabular portions 44 of the inserts 18 fit into the openings. If inserts 18 have serrated edges instead of tabular portions, the openings 74 and 78 would have similar shapes. Also protruding portion 70 can be longer than the other protruding portions to ensure retention of inserts in opening 78. The front and backing sheets inserted in openings 72 and 76, respectively, would ensure retention of inserts in openings 74.

It is noted that use of the holding device 60 illustrated in FIGS. 4–6 is similar to the use of the holding member 16 described in conjunction with FIGS. 1–3. The holding device 60, with the front and backing sheets attached thereto, is positioned in the binder 12 with one edge of the backing sheet 12 being held by the rings in the binder. The front sheet is then folded back and inserts are positioned in the holding device with one edge of the inserts being held by the rings and the other edge being inserted into the openings 74 in the device 60. Selection and positioning of inserts to form a compiled document is the same as with the embodiment illustrated in FIGS. 1–3.

Figure 7:
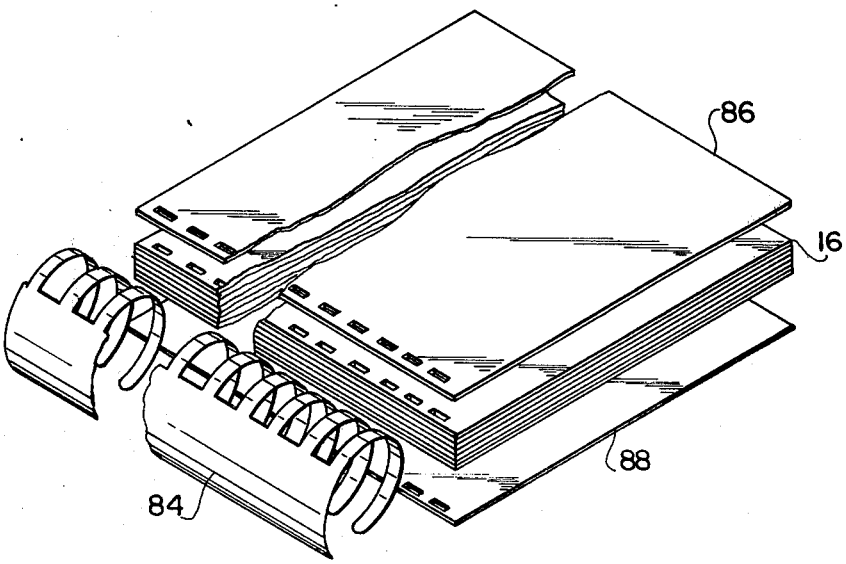
FIG. 7 is a perspective view with parts broken away showing an alternative embodiment of applicant's invention.

Turning now to the embodiment illustrated in FIG. 7, a form book is illustrated having a plastic binding element 84 adapted to secure plastic covers 86 and 88 which protect a plurality of holding members 16. Alternatively, holding devices 60 can be used instead of the holding members 16. A plurality of inserts 18 is arranged in each of the holding members or holding devices as previously described with the embodiments illustrated in FIGS. 1–6. The embodiment of applicant's invention illustrated in FIG. 7 is intended for use where there is little or no need to update the information contained in the inserts 18.

In another embodiment of applicant's invention (not illustrated), the front sheet 28 of the holding member 16 is elminated. The tabular portions 44 of the inserts 18 are held in the openings 38 in the backing sheet 26. If there is a need to write on the inserts, the inserts are treated, such as, by lamination or by printing the inserts on glossy paper, to allow writing directly on the inserts. The inserts may also be held in position by placing a rubber band or similar means around the backing sheet and the inserts.

The invention has been described in detail with particular reference to preferred embodiments thereof, but it will be understood that variations and modifications can be effected within the spirit and scope of the invention.

Some non-limiting examples of use of the form book of the present invention include:

a. preparation of request for contract proposals. With this use the names of individuals to receive proposals are positioned in one stack of inserts. Other stacks of inserts include such alternative paragraphs as cost plus fixed fee, fixed price, and other alternatives.

b. preparation of orders by purchasing agent. With this use, different quantities and types of materials are identified on the inserts. Also, such terms as different deadline dates and warranty clauses appear on inserts.

c. listing of engineering specifications and standards for different communities and states.

d. preparation of tests by a teacher. With this use, the teacher prepares one examination and then places the questions on inserts. The inserts are rearranged to enable preparation of tests having the same questions with the questions arranged in different sequences.

e. preparation of menus. With this use, such items as sandwiches, beverages and vegetables are positioned on inserts within different stacks. To prepare a menue, a user need only select the appropriate item from each stack and either type, electrophotographically, or otherwise reproduce the selected menu.

f. sale of a blank form book. With this use, the user inserts desired information on the inserts and designs a personalized form book for any desired purpose.

I claim:

1. A device for holding elements containing information which are selectively combinable to form a compiled document having a plurality of pages, the device comprising:

a binder having a plurality of rings;

a plurality of first and second element holding means attached to the rings of said binder, each of said second element holding means being adapted to hold a plurality of elements arranged in a plurality of stacks, the stacks being arranged in juxtaposition with each other with one edge of each element being attached to the rings of said binder, said second element holding means including holding means for holding the top element in each stack in a predetermined position, the elements in each stack being movable in order from said second element holding means to a preceding one of said first element holding means to position a desired element as the top element thereby forming one page of the compiled document, each of said first element holding means including means for holding elements moved from the succeeding second element holding means, the compiled document being formed by selectively arranging the elements in a plurality of said second element holding means.

2. A device as claimed in claim 1 wherein a first and a second element holding means are combined into a holding member, the first element holding means of one holding member being adapted to hold elements moved in order from the second element holding means of the following holding member.

3. A device as claimed in claim 1 wherein two elements in one stack contain different identifying indicia and wherein two elements in another stack contain similar identifying indicia, the identifying indicia on an element in the one stack being matched with the identifying indicia on an element in another stack to compile a preselected page of the compiled document.

4. A device as claimed in claim 3 wherein each of the elements has a tabular portion for carrying the identifying indicia.

5. A device as claimed in claim 1 wherein each of said elements includes first aligning means in the edge opposite said rings and each of said second element holding means includes an opaque backing sheet having one edge attached to the rings of said binder, said holding means being attached to the edge of said backing sheet opposite the rings and having a central portion attached to said backing sheet and bottom and top portions positioned on either side of said central portion with second aligning means formed in both said bottom and top portions, one of said first and second aligning means including a protuberance and the other of said aligning means including a protuberance receiving notch portion engageable with a protuberance to hold an element in a predetermined position.

6. A device as claimed in claim 5 further including a transparent front sheet attached to the top of said top portion to close the top of said second aligning means thereby assuring the retention of said elements in said second aligning means.

7. A device as claimed in claim 5 wherein the bottom of said bottom portion of said holding means extends towards said rings to form a channel for holding said first aligning means.

8. A device as claimed in claim 1 wherein each of said second element holding means includes an opaque backing sheet having one edge attached to the rings of said binder and a transparent front sheet connected to the edge of the backing sheet opposite the attached edge.

9. A device as claimed in claim 8 wherein each of the elements is electrostatically adherent to the front sheet, the top element in each stack being held in a predetermined position by the adherence of the element to the front sheet.

10. A device as claimed in claim 8 wherein each of said second element holding means includes a plurality of apertures formed in the front sheet adjacent the connected edge, each of said elements including a tabular portion engageable with a selected one of said apertures in said front sheet to hold the element in a predetermined position in said second element holding means.

11. A device as claimed in claim 10 wherein said first element holding means is defined by a plurality of apertures formed in the backing sheet in alignment with the apertures formed in the front sheet, the apertures in the backing sheet being engageable with tabular portions of elements moved from the following second element holding means.

12. A device as claimed in claim 8 wherein one of the elements containing information includes a blank to be filled in by a user, the user filling in the blank by writing on the portion of the front sheet covering the element held in said predetermined position.

13. A device as claimed in claim 12 wherein the information is written on the front sheet with water soluble ink.

14. A device for holding elements containing printed legal information, the elements being selectively combinable to form a compiled legal document having a plurality of pages, said device comprising;

a binder having a plurality of rings; and a plurality of members connected to said rings for holding said elements in a plurality of adjacent stacks with each stack having elements containing variations of one type of legal information, each of the elements having one edge connected to said rings, the elements in each stack being movable from the front of one member to the back of the preceding member thereby positioning a desired element at the top of each stack to form one page of the legal document, the front of each member having means for holding the top element in a predetermined position and the back of each member having means for holding elements moved from the front of the succeeding member, the compiled legal document being formed by selectively positioning the elements held by a plurality of said members.

* * * * *